US011454051B2

(12) United States Patent
Nagaoka et al.

(10) Patent No.: US 11,454,051 B2
(45) Date of Patent: Sep. 27, 2022

(54) VEHICLE DOOR LATCH APPARATUS

(71) Applicant: MITSUI KINZOKU ACT CORPORATION, Yokohama (JP)

(72) Inventors: Tomoharu Nagaoka, Yokohama (JP); Hiroaki Fujiwara, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 172 days.

(21) Appl. No.: 16/627,007

(22) PCT Filed: Nov. 28, 2017

(86) PCT No.: PCT/JP2017/042536
§ 371 (c)(1),
(2) Date: Dec. 27, 2019

(87) PCT Pub. No.: WO2019/016974
PCT Pub. Date: Jan. 24, 2019

(65) Prior Publication Data

US 2020/0224461 A1 Jul. 16, 2020

(30) Foreign Application Priority Data

Jul. 20, 2017 (JP) ..... JP2017-140895

(51) Int. Cl.
*E05B 77/28* (2014.01)
*E05B 77/30* (2014.01)

(52) U.S. Cl.
CPC ..... *E05B 77/28* (2013.01); *E05B 77/30* (2013.01)

(58) Field of Classification Search
CPC .... E05B 77/28; E05B 77/30; Y10T 292/1047; Y10T 292/1082
See application file for complete search history.

(56) References Cited

U.S. PATENT DOCUMENTS 6,343,817 B1 * 2/2002 Watanabe ..... E05B 77/30 292/201
8,146,965 B2 4/2012 Akizuki et al.
(Continued)

FOREIGN PATENT DOCUMENTS

CN 101960082 A 1/2011
GB 2 354 796 A 4/2001
(Continued)

OTHER PUBLICATIONS

International Search Report dated Feb. 6, 2018, issued in counterpart International Application No. PCT/JP2017/042536 (1 page).
(Continued)

*Primary Examiner* — Kristina R Fulton
*Assistant Examiner* — Tal Saif
(74) *Attorney, Agent, or Firm* — WHDA, LLP

(57) ABSTRACT

In a vehicle door latch apparatus, a one-motion operation can be allowed. Switching element is in a double unlocked state when it is in the connected position and is in a double locked state when it is in the disconnected position. The double unlocked state enables a one-motion operation, in which switching element is linked to the release operation of first inside lever in order to switch the locking mechanism from the locked state to the unlocked state and in which the release operation of first inside lever is transmitted to second inside lever in order to open the door, and in the double locked state, switching element is not linked to the release operation of first inside lever, prevents the release operation of first inside lever from being transmitted to second inside lever and prevents the locking mechanism from being switched from the locked state to the unlocked state.

6 Claims, 11 Drawing Sheets

(56) References Cited

U.S. PATENT DOCUMENTS

| | | | | |
|---|---|---|---|---|
| 8,870,248 | B2 | 10/2014 | Graute | |
| 2001/0005080 | A1 | 6/2001 | Inoue | |
| 2002/0056996 | A1* | 5/2002 | Fukunaga | E05B 85/02 292/216 |
| 2005/0218661 | A1* | 10/2005 | Brose | E05B 77/26 292/216 |
| 2009/0241617 | A1* | 10/2009 | Takahashi | E05B 77/26 292/216 |
| 2010/0327609 | A1* | 12/2010 | Akizuki | E05B 77/28 292/85 |

FOREIGN PATENT DOCUMENTS

| | | | | | |
|---|---|---|---|---|---|
| GB | 2354796 | A | * | 4/2001 | E05B 77/283 |
| GB | 2457778 | A | * | 9/2009 | E05B 77/265 |
| JP | 2001-182409 | A | | 7/2001 | |
| JP | 2001-248347 | A | | 9/2001 | |
| JP | 4374674 | B2 | | 12/2009 | |
| JP | 4618318 | B2 | | 1/2011 | |
| JP | 2015224456 | A | * | 12/2015 | E05B 77/28 |
| WO | WO-2011148697 | A1 | * | 12/2011 | E05B 81/06 |

OTHER PUBLICATIONS

Notification of Reasons for Refusal dated Nov. 12, 2019, issued in counterpart JP Patent Application No. 2017-140895, w/English translation (7 pages).

Office Action dated Nov. 2, 2020, issued in counterpart CN Application No. 201780093053.4, with English translation (10 pages).

Extended European Search Report dated Mar. 31, 2021, issued in counterpart EP Application No. 17918305.8. (26 pages).

* cited by examiner

VEHICLE DOOR LATCH APPARATUS

BACKGROUND OF THE INVENTION

Field of the Invention

This application is based on and claims priority from Japanese Patent Application No. 2017-140895, filed on Jul. 20, 2017. This application is incorporated herein by reference in its entirety.

The present invention relates to a vehicle door latch apparatus that enables a one-motion operation.

Description of the Related Art

Conventionally, as described in Patent Document 1, a vehicle door latch apparatus has a mechanism that enables a so-called one-motion operation. According to the one-motion operation, even when a locking mechanism, which can be switched between a locked state and an unlocked state, is in the locked state, the locking mechanism is switched from the locked state to the unlocked state by a door opening operation of the inside handle that is provided on the inner side of a door, and the door is opened. From the viewpoint of anti-theft capability, this vehicle door latch apparatus includes, in addition to the above-mentioned mechanism, a double locking mechanism (the "idle mechanism" in the document 1) that can be switched between a double unlocked state ("the connected state" in the document 1) that allows the one-motion operation and a double locked state (the "disconnected state" in the document 1) that prevents the one-motion operation.

PRIOR-ART DOCUMENT

Patent Document

[Patent document 1] JP2001-182409A

SUMMARY OF THE INVENTION

The above and other objects, features and advantages of the present invention will become apparent from the following description with reference to the accompanying drawings which illustrate examples of the present invention.

Problem to be Solved

However, in the vehicle door latch apparatus described in Patent Document 1, the component for switching the double locking mechanism between the double unlocked state and the double locked state (the "engagement pin 81") and the component for switching the locking mechanism from the locked state to the unlocked state by the one-motion operation (the "outer arm 35A" of ratchet lever 35) are different components. Therefore, this vehicle door latch apparatus has the problem that its configuration is complicated.

In view of the above-mentioned technical problem, the present invention aims at providing a vehicle door latch apparatus that has a simple configuration to allow and to prevent a one-motion operation.

Means of Solving the Problem

In order to solve the technical problem, the technical means of the present invention comprises: a locking mechanism that can switch between an unlocked state in which a door can be opened by operation of an outside handle that is provided on an outer side of the door and a locked state in which the door cannot be opened by the operation of the outside handle; a first inside lever that performs a releasing operation by an operation of an inside handle that is provided on an inner side of the door; a second inside lever that can be linked to and unlinked from the release operation of the first inside lever and a switching element that can move to a connected position and to a disconnected position, wherein the release operation of the first inside lever can be transmitted to the second inside lever in the connected position, and the release operation of the first inside lever cannot be transmitted to the second inside lever in the disconnected position. The switching element is in a double unlocked state when the switching element is in the connected position and is in a double locked state when the switching element is in the disconnected position, wherein the double unlocked state enables a one-motion operation, in which the switching element is linked to the release operation of the first inside lever in order to switch the locking mechanism from the locked state to the unlocked state and in which the release operation of the first inside lever is transmitted to the second inside lever in order to open the door, and in the double locked state, the switching element is not linked to the release operation of the first inside lever, prevents the release operation of the first inside lever from being transmitted to the second inside lever and prevents the locking mechanism from being switched from the locked state to the unlocked state.

Preferably, when the switching element is in the connected position, the switching element abuts a part of the locking mechanism and thereby switches the locking mechanism from the locked state to the unlocked state.

Preferably, an abutting portion of the switching element is within a trajectory of rotation of an abutting portion of the first inside lever when the switching element is in the connected position, and the switching element transmits the release operation of the first inside lever to the second inside lever.

Preferably, the abutting portion of the switching element is outside of a trajectory of rotation of the abutting portion of the first inside lever when the switching element is in the disconnected position, and the switching element prevents the release operation of the first inside lever from transmitting to the second inside lever.

Preferably, the switching element is supported by the second inside lever such that the switching element is movable in a radial direction of the second inside lever.

Preferably, the switching element has a through hole, and the switching element is supported by the second inside lever by being inserted into the through hole.

Preferably, the first inside lever and the second inside lever are supported by a same shaft.

Effect of the Invention

According to the present invention, the configuration can be simplified because the switching element is moveable between the connected position that allows the one-motion operation and the disconnected position that prevents the one-motion operation, and the locking mechanism is switched from the locked state to the unlocked state by the one-motion operation.

DETAILED DESCRIPTION OF THE INVENTION

Figure 1:
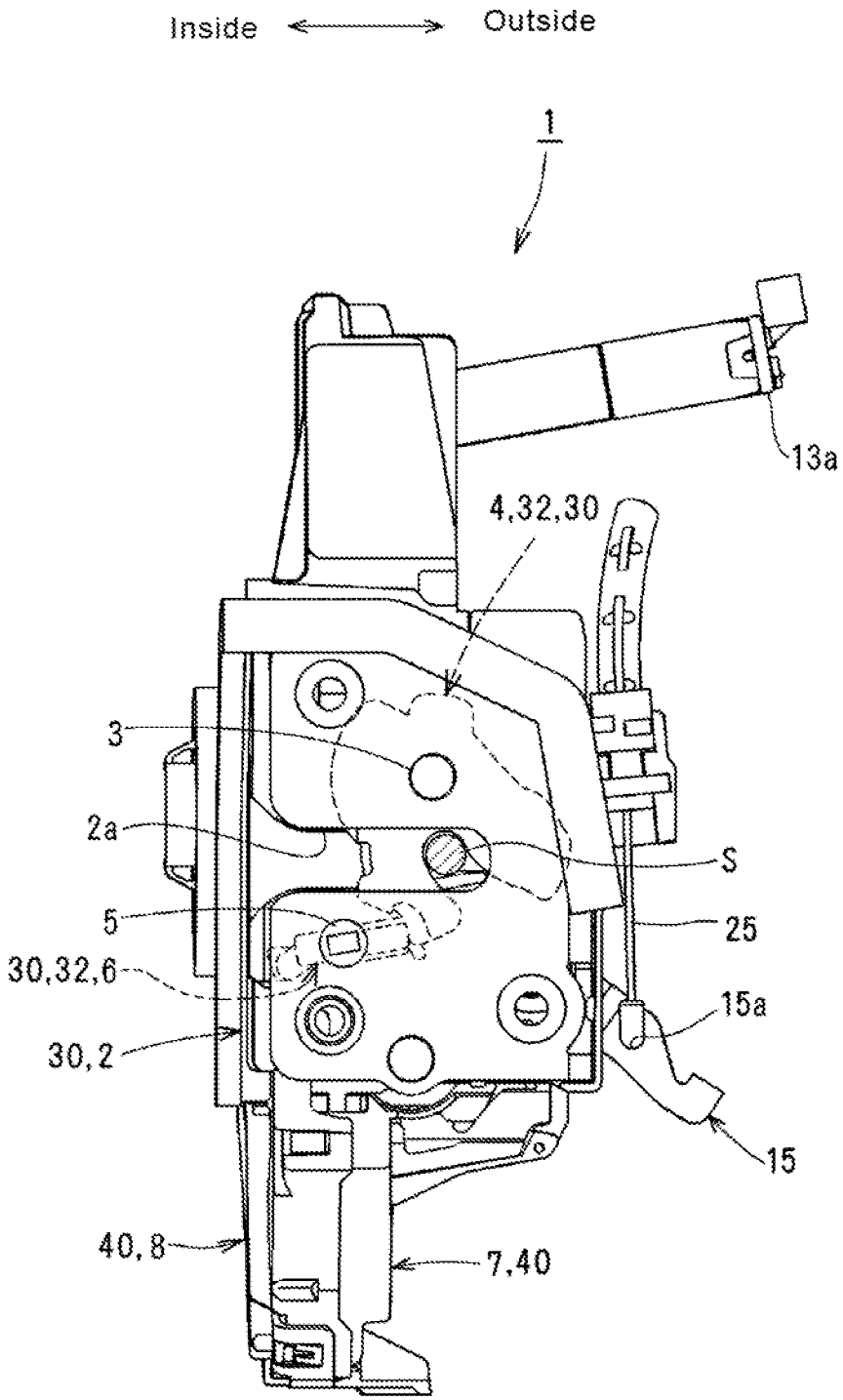
FIG. 1 is a front view of a vehicle door latch apparatus according to the present invention.

As shown in FIG. 1, vehicle door latch apparatus 1 has engaging unit 30 that includes engaging elements 32, which will be described later, and operating unit 40 that includes operating elements 42, which will be described later. Engaging elements 32 are disposed in the rear end of the driver's door, which is openably and closably supported by the vehicle body, and are provided to keep the door in the closed state by engaging with striker S of the vehicle body. Operating elements 42 are provided to operate engaging elements 32.

Figure 2:
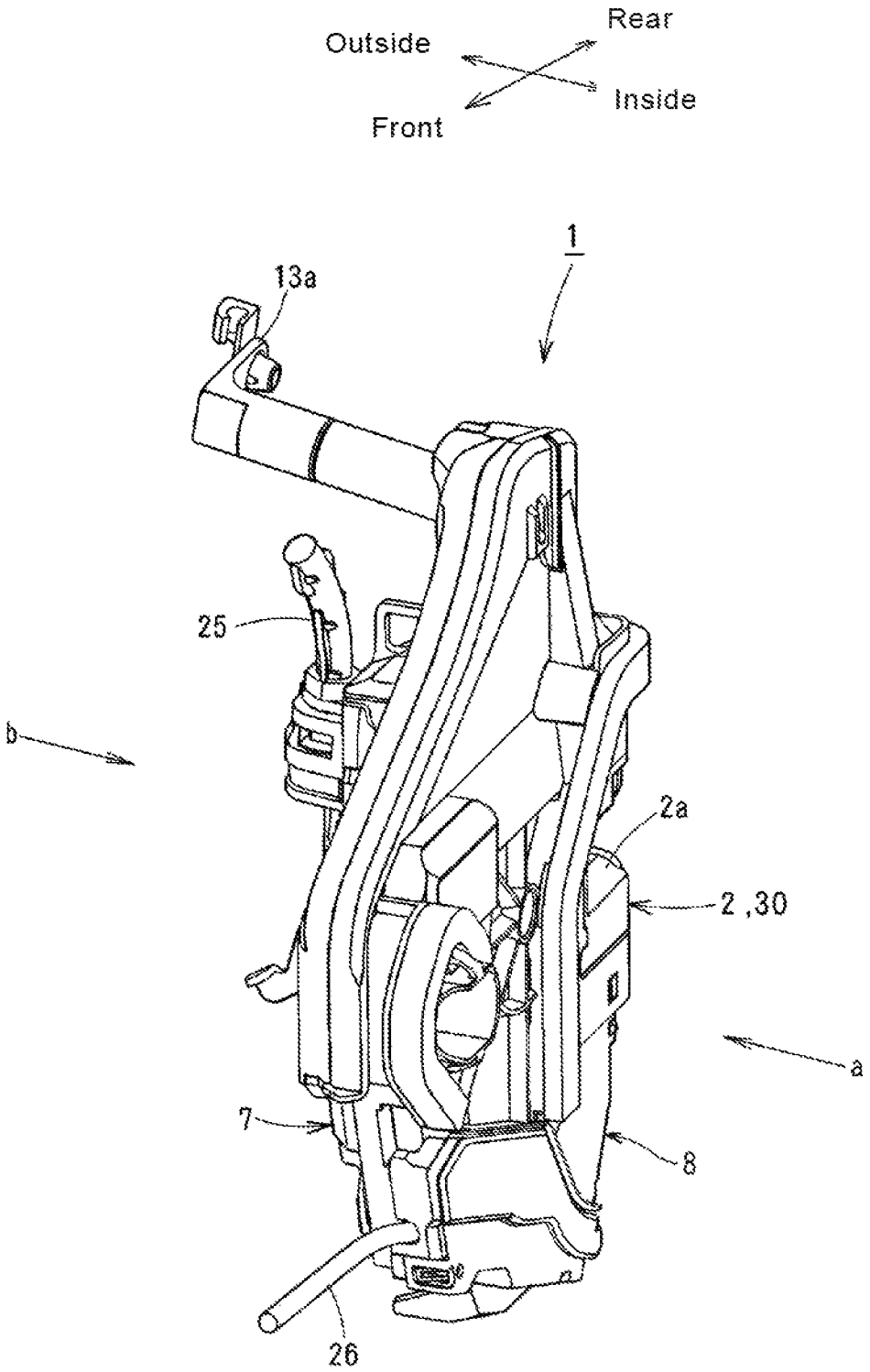
FIG. 2 is a perspective view of the vehicle door latch apparatus, as viewed diagonally from the front.

As shown in FIGS. 1 and 2, engaging unit 30 includes first housing 2 that is fixed to the door, as well as engaging elements 32 that are disposed in first housing 2. Main components of engaging elements 32 include latch 4 that is rotatably supported by shaft 3 and ratchet 6 that is rotatably supported by shaft 5.

When the door is closed, latch 4 engages with striker S that enters striker entering groove 2*a* of housing 2 from left in FIG. 1, so that latch 4 is rotated counterclockwise from the open position (the position after rotating clockwise about 90 degrees from the full latched position shown in FIG. 1) to the full latched position. In the present specification, the "clockwise direction" means a direction in which the rotating direction is clockwise, and the "counterclockwise direction" means a direction in which the rotating direction is counterclockwise.

Ratchet 6 engages with the outer periphery of latch 4 that has moved to the full latched position in order to prevent latch 4 from rotating in the opening direction (the clockwise direction in FIG. 1) and keeps the door closed. Further, ratchet 6 is disengaged from latch 4 and opens the door by performing a release operation (rotation in the clockwise direction in FIG. 1) from the engaging position (the position shown in FIG. 1) where ratchet 6 engages with latch 4.

Operation unit 40 includes second housing 7 made of a synthetic resin that is fixed to first housing 2 so as to cover the back surface of first housing 2, as well as cover 8 that closes the opening of second housing 7 that faces the inside of the vehicle.

Figure 3:
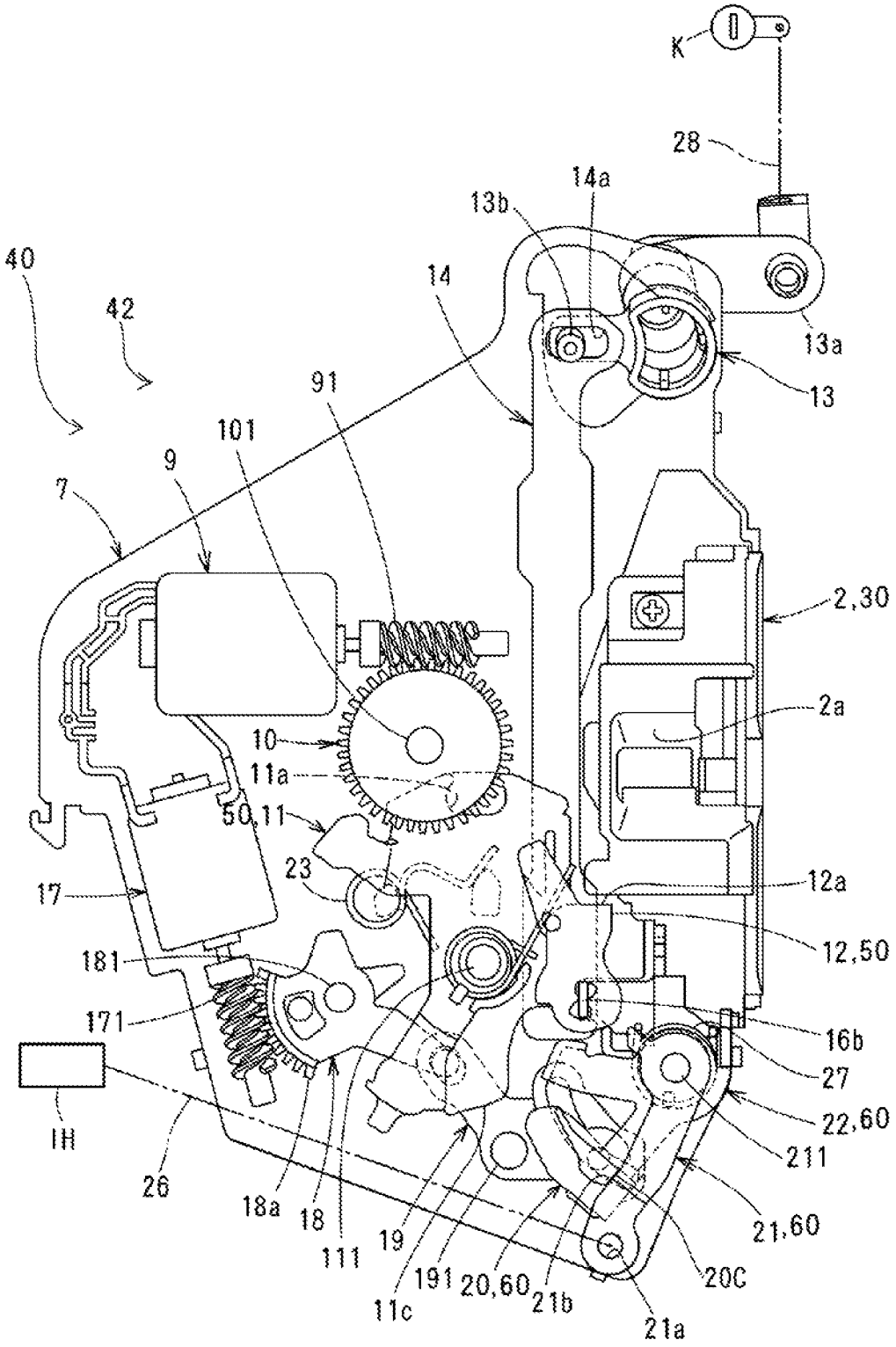
FIG. 3 is a side view of the vehicle door latch apparatus, as viewed from the direction of arrow "a" shown in FIG. 2.

As shown in FIG. 3, first motor 9, worm wheel 10, locking lever 11, sub-lever 12, key lever 13, slide lever 14, second motor 17, first connecting lever 18, second connecting lever 19, switching element 20, first inside lever 21 and second inside lever 22, all of which are operating elements 42, are disposed between second housing 7 and cover 8 (not shown in FIG. 3).

Worm wheel 10 is rotatably supported by support shaft 101. Locking lever 11 is rotatably supported by support shaft 111. Sub-lever 12 is connected to locking lever 11. Key lever 13 is connected to key cylinder K that is provided on the outer side of the door. Slide lever 14 is connected to key lever 13. First connecting lever 18 is rotatably supported by support shaft 181. Second connecting lever 19 is rotatably supported by support shaft 191. Switching element 20 is connected to second connecting lever 19. First inside lever 21 is rotatably supported by support shaft 211 and is connected to inside handle IH that is provided on the inner side of the door. Second inside lever 22 is rotatably supported by the shaft that supports first inside lever 21.

Figure 4:
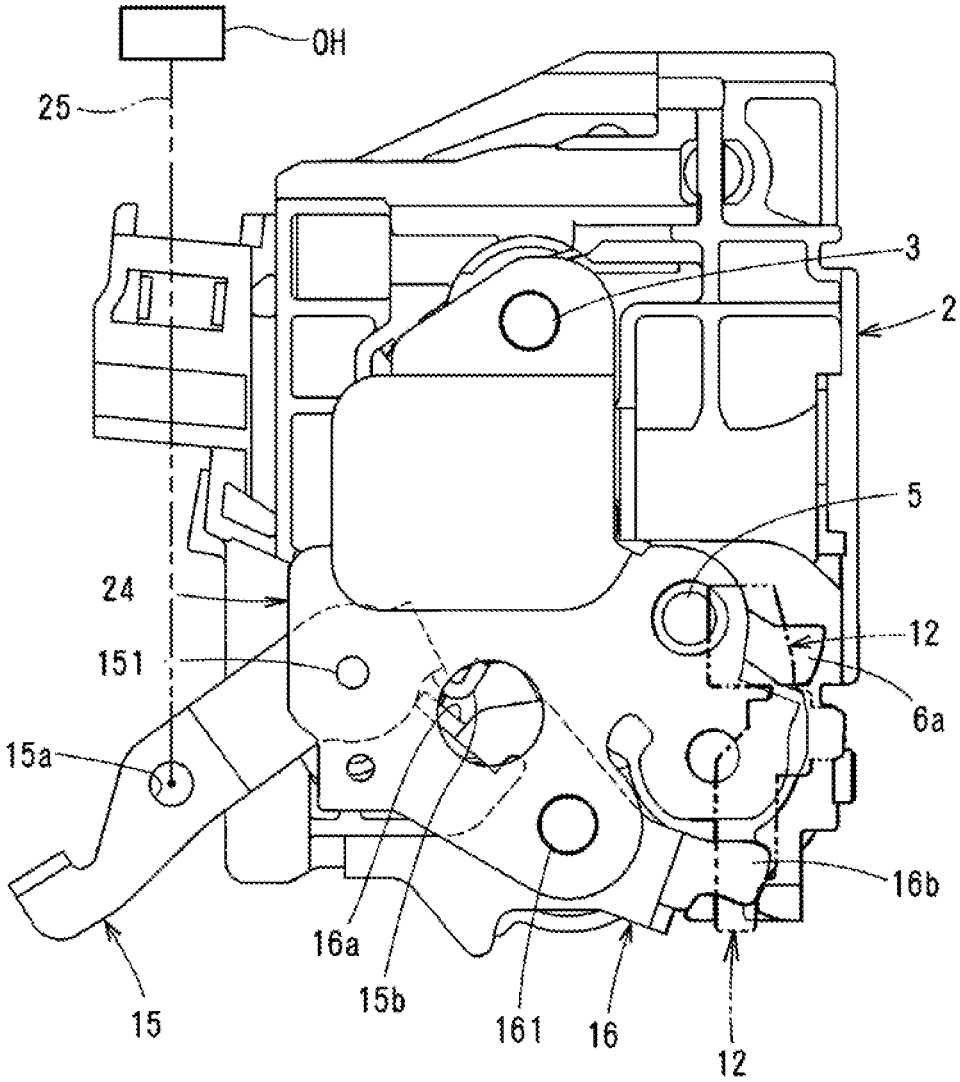
FIG. 4 is a rear view of the engaging unit.

As shown in FIG. 4, first outside lever 15 and second outside lever 16, all of which are operating elements 42, are disposed between the rear surface of first housing 2 and second housing 7.

First outside lever 15 is rotatably supported by support shaft 151 and is connected to outside handle OH that is provided on the outer side of the door. Second outside lever 16 is rotatably supported by support shaft 161.

Locking lever 11 and sub-lever 12 are components that constitute locking mechanism 50 of vehicle door latch apparatus 1 according to the present embodiment (see FIGS. 5 to 11).

In a state in which locking lever 11 and sub-lever 12 are in the unlocked position, described later, (hereinafter referred to as "unlocked state"), the door can be opened by the door opening operation of outside handle OH, as well as by the door opening operation of inside handle IH, in the manner described later. In a state in which locking lever 11 and sub-lever 12 are in the locked position, described later, (hereinafter, referred to as "locked state"), the door cannot be opened by the door opening operation of outside handle OH. However, as described later, locking mechanism 50 can be switched from the locked state to the unlocked state and the door can be opened by the door opening operation of inside handle IH. The door opening operation of inside handle IH in this operation is referred to as the one-motion operation.

The one-motion operation is allowed when double locking mechanism 60, described later, is in the double unlocked state, described later, and is prevented when double locking mechanism 60 is in the double locked state.

Switching element 20 and second inside lever 22 are components that constitute double locking mechanism 60 of vehicle door latch apparatus 1 according to the present embodiment (see FIGS. 3, 5 to 11). Double locking mechanism 60 only affects the door opening operation of inside handle IH, and does not have any influence on the door opening operation of outside handle OH.

Figure 7:
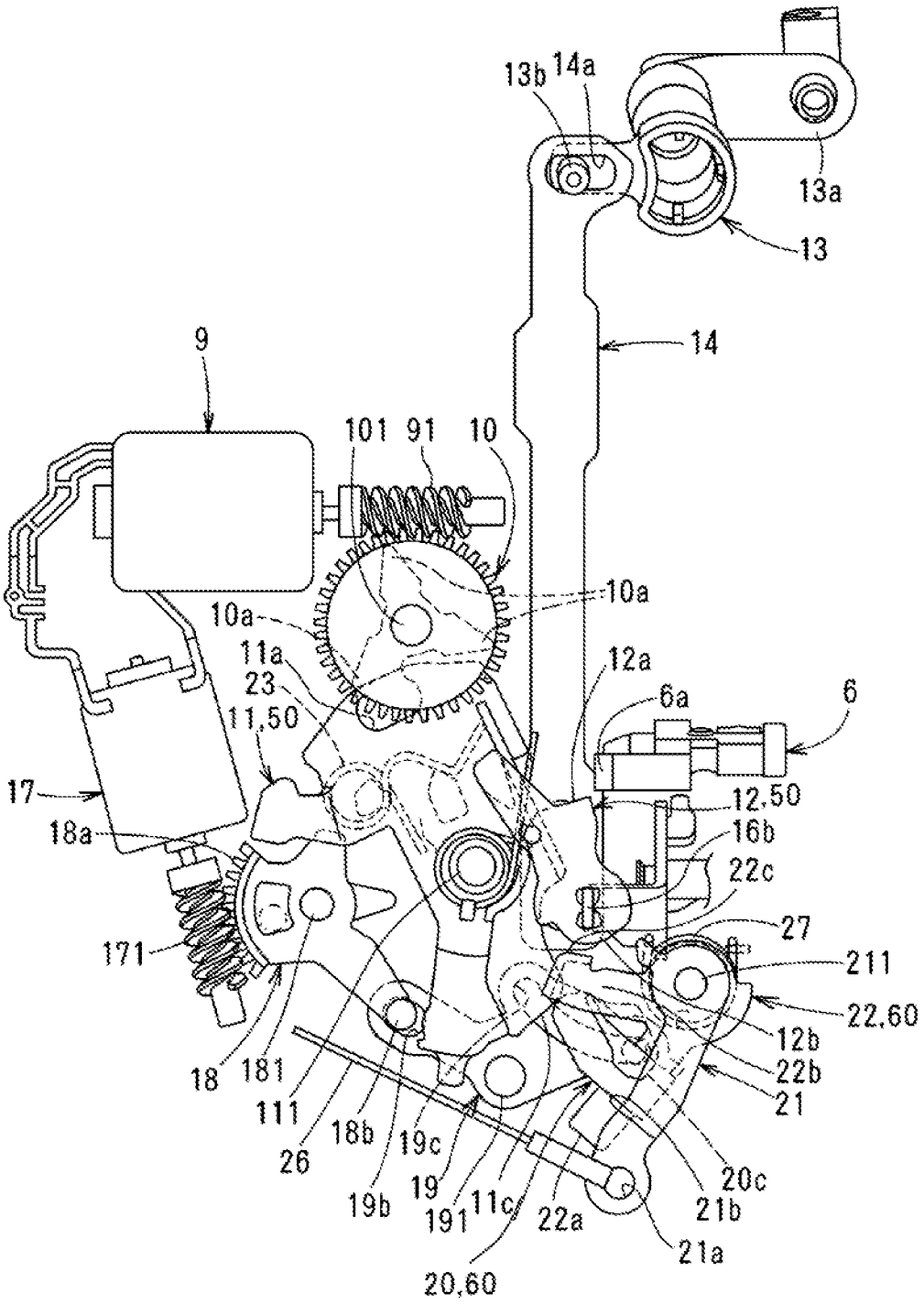
FIG. 7 is a side view of the main part when the locking mechanism is in the locked state and the double locking mechanism is in the double locked state.

It should be noted that when double locking mechanism 60 is in the double locked state, locking mechanism 50 is always in the locked state (see FIG. 7).

In a state in which switching element 20 is in the connected position, described later, (hereinafter referred to as "double unlocked state"), even when locking mechanism 50 is in the locked state, the door can be opened by the one-motion operation of inside handle IH (see FIGS. 5 and 6).

On the other hand, in a state in which switching element 20 is in the disconnected position, described later, (hereinafter referred to as "double-locked state"), the one-motion operation of inside handle IH is prevented. As a result, locking mechanism 50 cannot be switched from the locked state to the unlocked state, and the door cannot be opened (see FIG. 7).

The door having vehicle door latch apparatus 1 of the present embodiment is not provided with a lock button that would allow locking mechanism 50 to be manually switched between the unlocked state and the locked state from inside of the vehicle. Therefore, in vehicle door latch apparatus 1 that is disposed in the driver's door, it is only possible to switch locking mechanism 50 between the unlocked state and the locked state by activating first motor 9 by means of a portable remote operation switch (not shown) or by manually operating key cylinder K.

In addition, key cylinder K is not provided in any door other than the driver's door. Therefore, in the case of doors other than the driver's door, it is only possible to switch locking mechanism 50 between the unlocked state and the locked state by activating first motor 9 by means of the portable remote operation switch.

Figure 5:
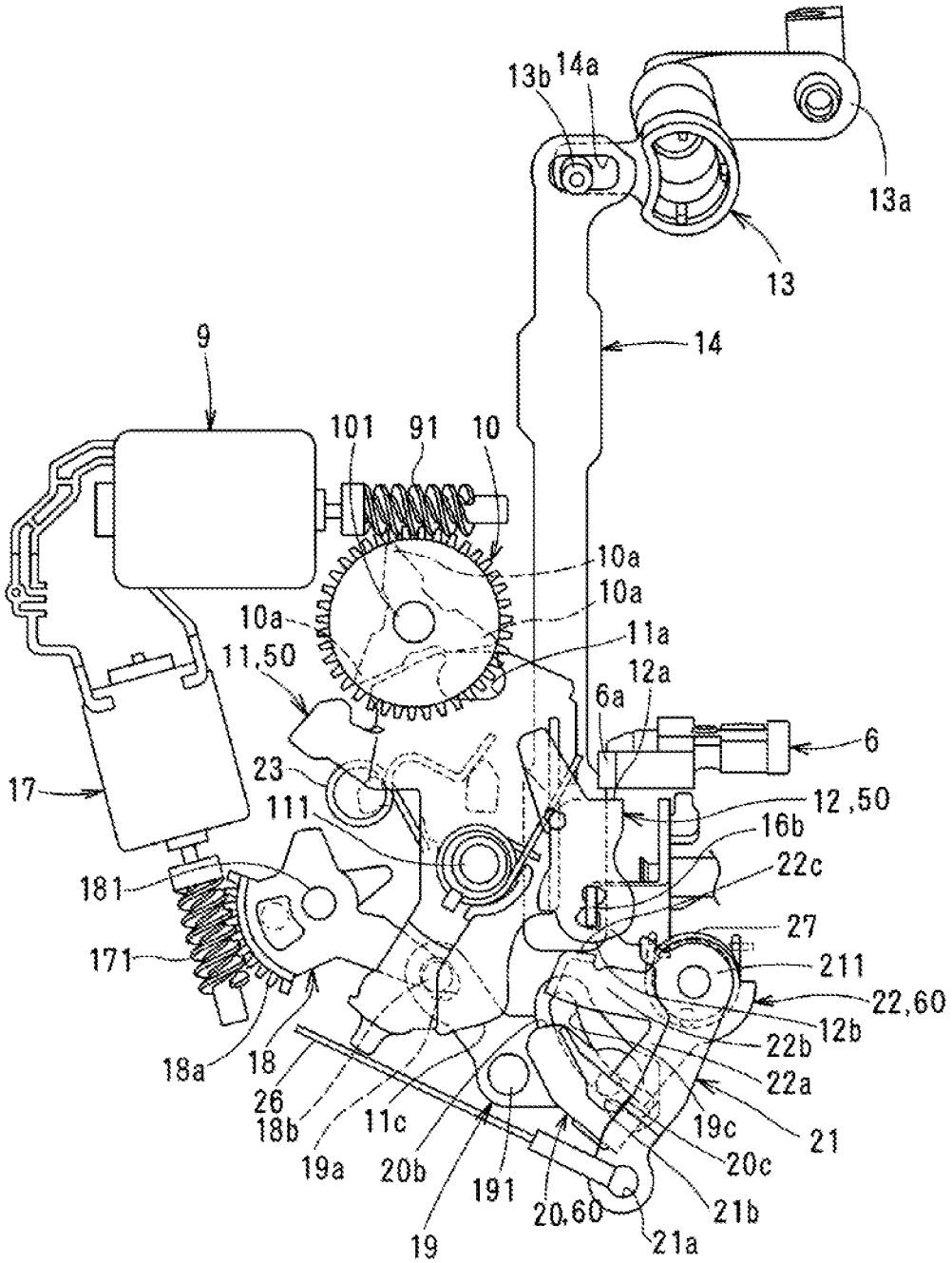
FIG. 5 is a side view of the main part when the locking mechanism is in the unlocked state and the double locking mechanism is in the double unlocked state.
Figure 6:
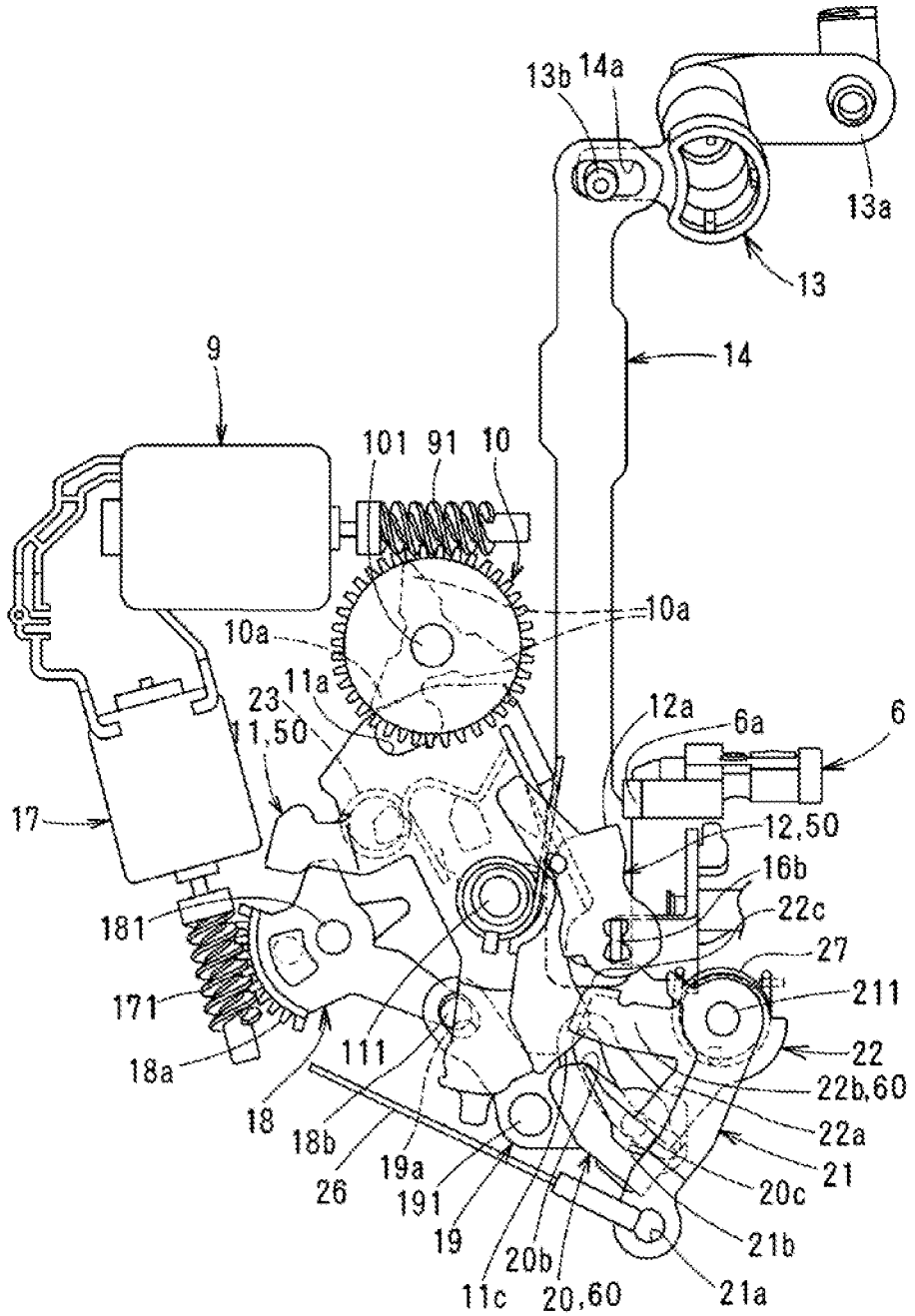
FIG. 6 is a side view of the main part when the locking mechanism is in the locked state and the double locking mechanism is in the double unlocked state.

As shown in FIGS. 5 to 7, first motor 9 is rotated in one direction or in the opposite direction by the operation of the portable remote operation switch. The rotation of first motor 9 is transmitted to locking lever 11 via worm wheel 10.

Worm wheel 10 engages with worm 91 that is fixed to the rotation shaft of first motor 9. Worm wheel 10 is rotated clockwise in one direction by predetermined angles by the rotation of first motor 9 and is rotated counterclockwise by predetermined angles by reverse rotation. Worm wheel 10 has a plurality of protrusions 10*a* (three protrusions in this embodiment) on the back surface thereof.

Locking lever 11 has a single engaging groove 11*a* on the outer periphery thereof. Engaging groove 11*a* can engage with protrusion 10*a* of worm wheel 10.

When worm wheel 10 is rotated clockwise in one direction from the position shown in FIG. 5 by the rotation of first motor 9, one of projections 10*a* engages with engaging groove 11*a* from right. As a result, locking lever 11 is rotated counterclockwise by predetermined angles from the unlocked position shown in FIG. 5 to be moved to and held at the locked position shown in FIG. 6.

When worm wheel 10 is rotated counterclockwise from the locked position shown in FIG. 6 by the reverse rotation of first motor 9, one of projections 10*a* engages with engaging groove 11*a* from left. As a result, locking lever 11 is rotated clockwise by predetermined angles from the locked position to be moved to and held at the unlocked position.

Locking lever 11 is held at the unlocked position or at the locked position by the biasing force of spring 23 (see FIGS. 5 to 7) that is supported by second housing 7.

In addition, locking lever 11 can also be moved both to the unlocked position and to the locked position by manually operating key cylinder K that is provided on the outer side of the door, as will be described later.

Sub-lever 12 has releasing portion 12*a* that can abut against arm portion 6*a* of ratchet 6 from below. The lower portion of sub lever 12 is connected to arm portion 16*b* of second outside lever 16 such that sub lever 12 can be rotated by predetermined angles, and the upper portion of sub lever 12 is connected to locking lever 11 such that sub lever 12 can slide in the vertical direction. As a result, sub lever 12 works in conjunction with locking lever 11 moving from the unlocked position to the locked position to be rotated counterclockwise by predetermined angles about arm portion 16*b* of second outside lever 16 from the unlocked position shown in FIG. 5 to the locked position shown in FIG. 6. Sub lever 12 also works in conjunction with locking lever 11 moving from the locked position to the unlocked position to be rotated clockwise by predetermined angles about arm portion 16*b* from the locked position to the unlocked position.

Further, when second outside lever 16 or second inside lever 22 performs a release operation, as described later, sub lever 12 works in conjunction with the release operation to perform a release operation (upward movement). Thus, when locking lever 11 is in the unlocked position, releasing portion 12*a* abuts against arm portion 6*a* of ratchet 6 from below by the release operation of sub-lever 12 and causes ratchet 6 to perform a release operation (see FIG. 9). On the other hand, when locking lever 11 is in the locked position, even if sub-lever 12 performs the release operation, releasing portion 12*a* does not abut against arm portion 6*a* of ratchet 6 and prevents ratchet 6 from performing the release operation.

Key lever 13 is operation element 42 to which the operation of key cylinder K is input. Key lever 13 is supported in the upper portion of second housing 7 such that it can be rotated about a shaft that extends in the vehicle inside-outside direction, and outer arm portion 13*a* is connected to key cylinder K via coupling rod 28 that vertically extends. As a result, key lever 13 is rotated in the locking direction (counterclockwise in FIG. 5) by predetermined angles from the neutral position shown in FIG. 5 based on the locking operation of key cylinder K, and is similarly rotated in the unlocking direction (clockwise in FIG. 6) by predetermined angles from the neutral position shown in FIG. 6 based on the unlocking operation.

Figure 11:
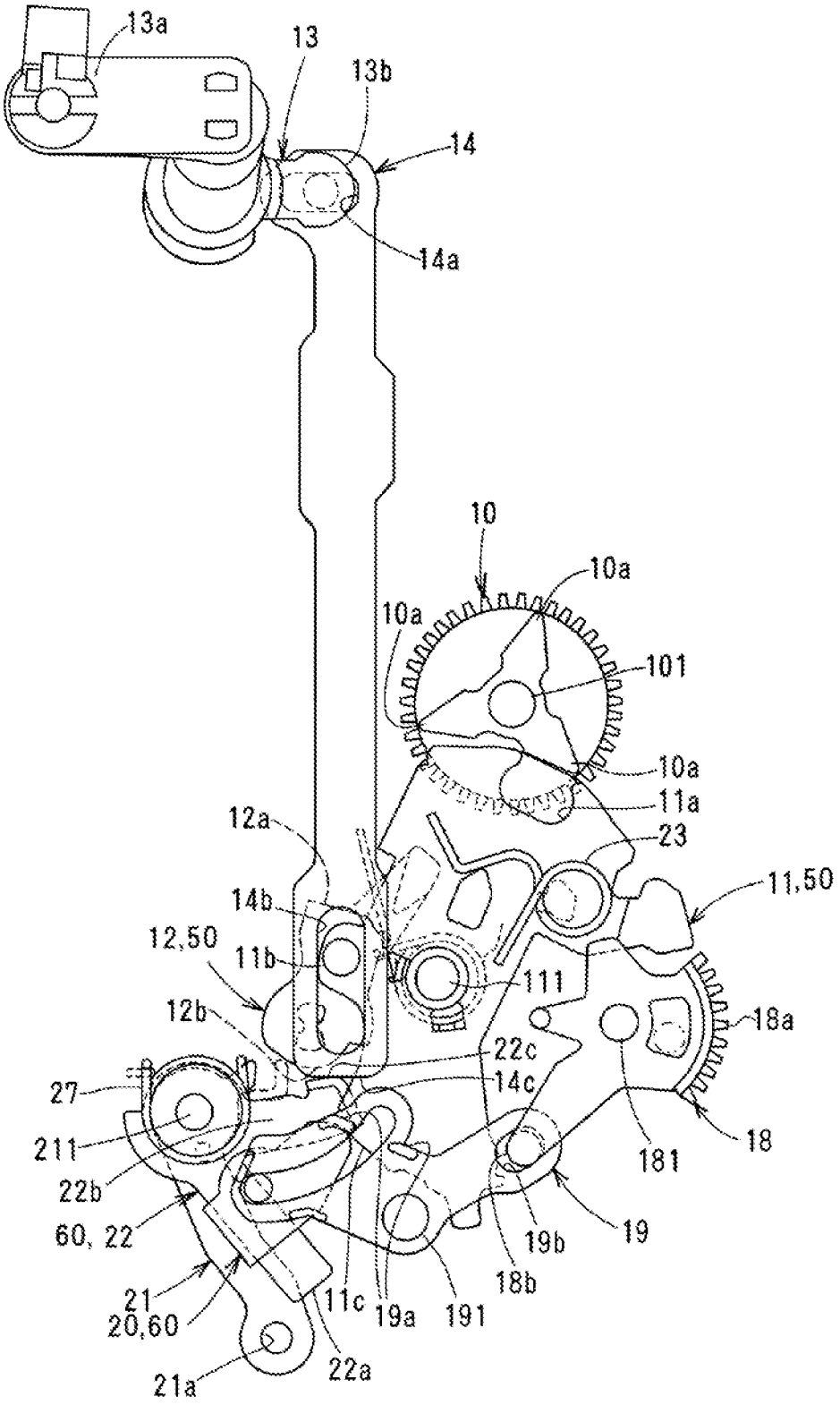
FIG. 11 is a side view of the main part, as viewed from the direction of arrow "b" shown in FIG. 2.

As shown in FIGS. 5 to 7, inner arm portion 13*b* of key lever 13 is connected to elongate hole 14*a* in the upper portion of slide lever 14, and as shown in FIG. 11, connecting protrusion 11*b* of locking lever 11 is connected to elongate hole 14*b* in lower portion. As a result, slide lever 14 works in conjunction with key lever 13 rotating in the locking direction to be moved upward from the neutral position shown in FIGS. 5 to 7, and similarly works in conjunction with key lever 13 rotating in the unlocking direction to be moved downward from the neutral position.

When slide lever 14 is moved upward from the neutral position, the lower end of elongate hole 14*b* abuts against coupling protrusion 11*b* of locking lever 11 from below. As a result, slide lever 14 moves locking lever 11 from the unlocked position to the locked position to switch locking mechanism 50 from the unlocked state to the locked state. When slide lever 14 is moved downward from the neutral position, the upper end of elongate hole 14*b* abuts against coupling protrusion 11*b* of locking lever 11 from above. As a result, slide lever 14 moves locking lever 11 from the locked position to the unlocked position to switch locking mechanism 50 from the locked state to the unlocked state. Further, when slide lever 14 is moved downward by the operation of the key cylinder, lower end portion 14*c* of slide lever 14 abuts against protrusion 19*a* of second connecting lever 19 (see FIG. 11) from above. As a result, slide lever 14 pushes down second connecting lever 19 in order to move switching element 20 from the disconnected position to the connected position.

As shown in FIG. 4, first outside lever 15 is operation element 42 to which the door opening operation of outside handle OH is input. First outside lever 15 is rotatably supported by support shaft 151 between the back surface of first housing 2 and metallic back plate 24 that is fixed to the back surface, and is connected to outside handle OH via vertically extending Bowden cable 25 (see FIGS. 1 and 2) at connecting hole 15*a*. As a result, when the door opening operation is performed by outside handle OH, first outside lever 15 performs a release operation in which first outside lever 15 rotates clockwise by predetermined angles about support shaft 151 from the standby position shown in FIG. 4.

Second outside lever 16 is operating element 42 that transmits the release operation of first outside lever 15 to sub-lever 12. Second outside lever 16 is rotatably supported by support shaft 161 between first housing 2 and back plate 24, and has abutting portion 16*a* that can abut against bent portion 15*b* of first outside lever 15 in the rotating direction. As a result, when first outside lever 15 performs the release operation, bent portion 15*b* abuts against abutting portion 16*a* to cause second outside lever 16 to performs a release operation, in which second outside lever 16 rotates counterclockwise from the standby position shown in FIG. 4. The release operation of second outside lever 16 is transmitted to sub lever 12 that is connected to arm portion 16*b*. As a result, sub lever 12 works in conjunction with second outside lever 16 to perform a release operation. When sub lever 12 is in the unlocked position, sub lever 12 causes ratchet 6 to perform a release operation, and when sub lever 12 is in the locked position, sub lever 12 does not cause ratchet 6 to perform the release operation.

First inside lever 21 is operation element 42 to which the door opening operation of inside handle IH is input. Connecting portion 21*a* at the lower end of first inside lever 21 is connected to inside handle IH via Bowden cable 26. As a result, when a door opening operation is performed by inside handle IH, first inside lever 21 is rotated clockwise from the standby position shown in FIGS. 5 to 7 against the biasing force of spring 27 (hereinafter referred to as "release operation").

Second inside lever 22 is rotatably supported by the shaft that supports first inside lever 21, and can be linked to and unlinked from the operation of first inside lever 21 depending on the position of switching element 20 that is slidably supported by first arm portion 22*a* in the radial direction thereof. Second inside lever 22 has release abutting portion 22*c* that can abut lower portion 12*b* of sub lever 12 from below when second inside lever 22 is connected to the operation of first inside lever 21. When release abutting portion 22*c* abuts lower portion 12*b* of sub lever 12, sub lever 12 works in conjunction with the operation of second inside lever 22 to perform the release operation.

Second motor 17 is a power source for switching double locking mechanism 60 from the double unlocked state to the double locked state and for switching double locking mechanism 60 in the opposite direction. Second motor 17 is rotated in one direction by inputting locking operation to the portable switch when locking mechanism 50 is in the locked state, and is reversed by inputting unlocking operation to the portable switch when double locking mechanism 60 is in the double locked state. The rotation of second motor 17 is transmitted to first connecting lever 18 via worm 171 that is fixed to the rotation shaft of second motor 17.

Sector gear portion 18*a* on the outer periphery of first connecting lever 18 engages with worm 171 of second motor 17. As a result, by the rotation of second motor 17 in one direction, first connecting lever 18 is rotated in the disconnecting direction (clockwise in FIGS. 5 and 6) by predetermined angles about support shaft 181 from the connected position shown in FIGS. 5 and 6 to the disconnected position shown in FIGS. 7 and 11. Further, by the reverse rotation of second motor 17, first connecting lever 18 is rotated in the connecting direction (counterclockwise in FIG. 7 and clockwise in FIG. 11) by predetermined angles from the disconnected position to the connected position.

Elongate hole 19*b* that is provided at one end portion of second connecting lever 19 is connected to end portion 18*b* of first connecting lever 18, and arc hole 19*c* (see FIG. 1) that is provided at the other end portion is connected to switching element 20. As a result, the rotation of second motor 17 is transmitted to switching element 20 via first connecting lever 18 and second connecting lever 19.

Figure 8:
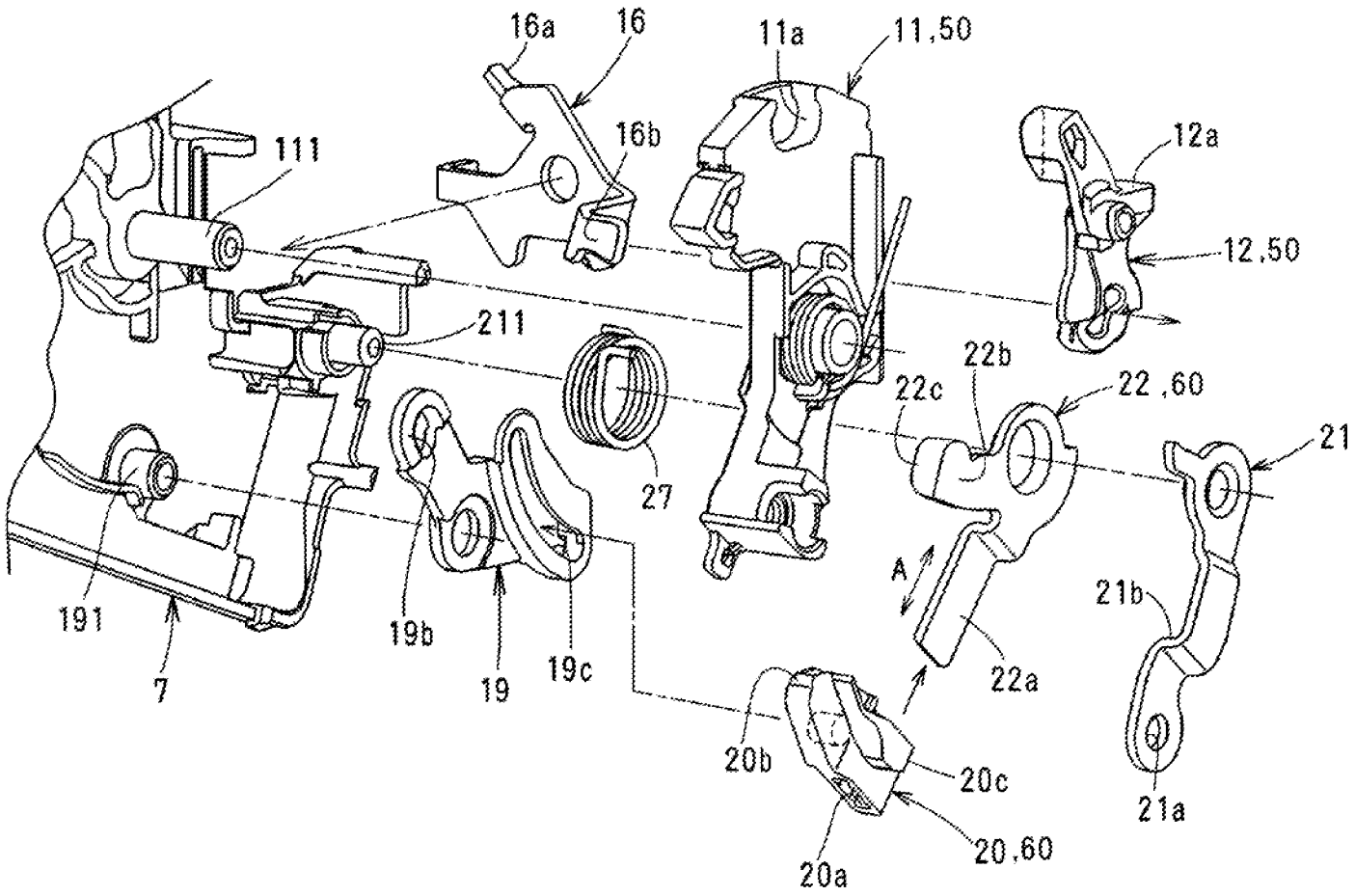
FIG. 8 is an exploded perspective view of the main part, as viewed diagonally from the front.

As can be seen from FIG. 8, switching element 20 is connected to arc hole 19*c* of second connecting lever 19 such that switching element 20 can slide along the arc. At the same time, first arm portion 22*a* of second inside lever 22 is slidably inserted into rectangular hole 20*a* (an example of a through hole) of switching element 20, and thereby switching element 20 is slidably supported in the radial direction of second inside lever 22 (the direction of arrow "A" in FIG. 8).

Switching element 20 slides along first arm portion 22*a* of second inside lever 22 in the radial direction of first arm portion 22*a* by the rotation of second connecting lever 19, and thereby moves to the connected position (see FIGS. 5 and 6), in which double locking mechanism 60 is in the double unlocked state that enables the one-motion operation, and moves to the disconnected position (see FIGS. 7 and 11), in which double locking mechanism 60 is in the locked state that prevents the one-motion operation. Further, when switching element 20 is in the connected position, switching element 20 works in conjunction with the release operation of first inside lever 21 to transmit the release operation to second inside lever 22.

As shown in FIG. 6, switching element 20 is provided with unlocking abutting portion 20*b* that can abut abutting portion 11*c* of locking lever 11 by the release operation of second inside lever 22 when switching element 20 is in the connected position and locking lever 11 is in the locked position. As a result, switching element 20 performs a release operation together with second inside lever 22, and unlocking abutting portion 20*b* abuts abutting portion 11*c* of locking lever 11 to cause locking lever 11 to move from the locked position to the unlocked position.

As shown in FIGS. 5 and 6, when switching element 20 is in the connected position, abutted portion 20*c* of switching element 20 is positioned within the trajectory of the rotation of abutting portion 21*b* of first inside lever 21. As a result, the release operation of first inside lever 21 is transmitted to second inside lever 22 via switching element 20.

As shown in FIG. 7, when switching element 20 is in the disconnected position, abutted portion 20*c* of switching element 20 moves outside of the trajectory of the rotation of abutting portion 21*b* of first inside lever 21. As a result, the release operation of first inside lever 21 is transmitted neither to switching element 20 nor to second inside lever 22.

Next, the operation of the present embodiment will be described.

As shown in FIG. 5, when locking mechanism 50 of vehicle door latch apparatus 1 is in the unlocked state and double locking mechanism 60 is in the double unlocked state, the door can be opened by performing the door opening operation of outside handle OH or inside handle IH and thereby causing ratchet 6 to perform the release operation via sub lever 12, as described above.

Figure 9:
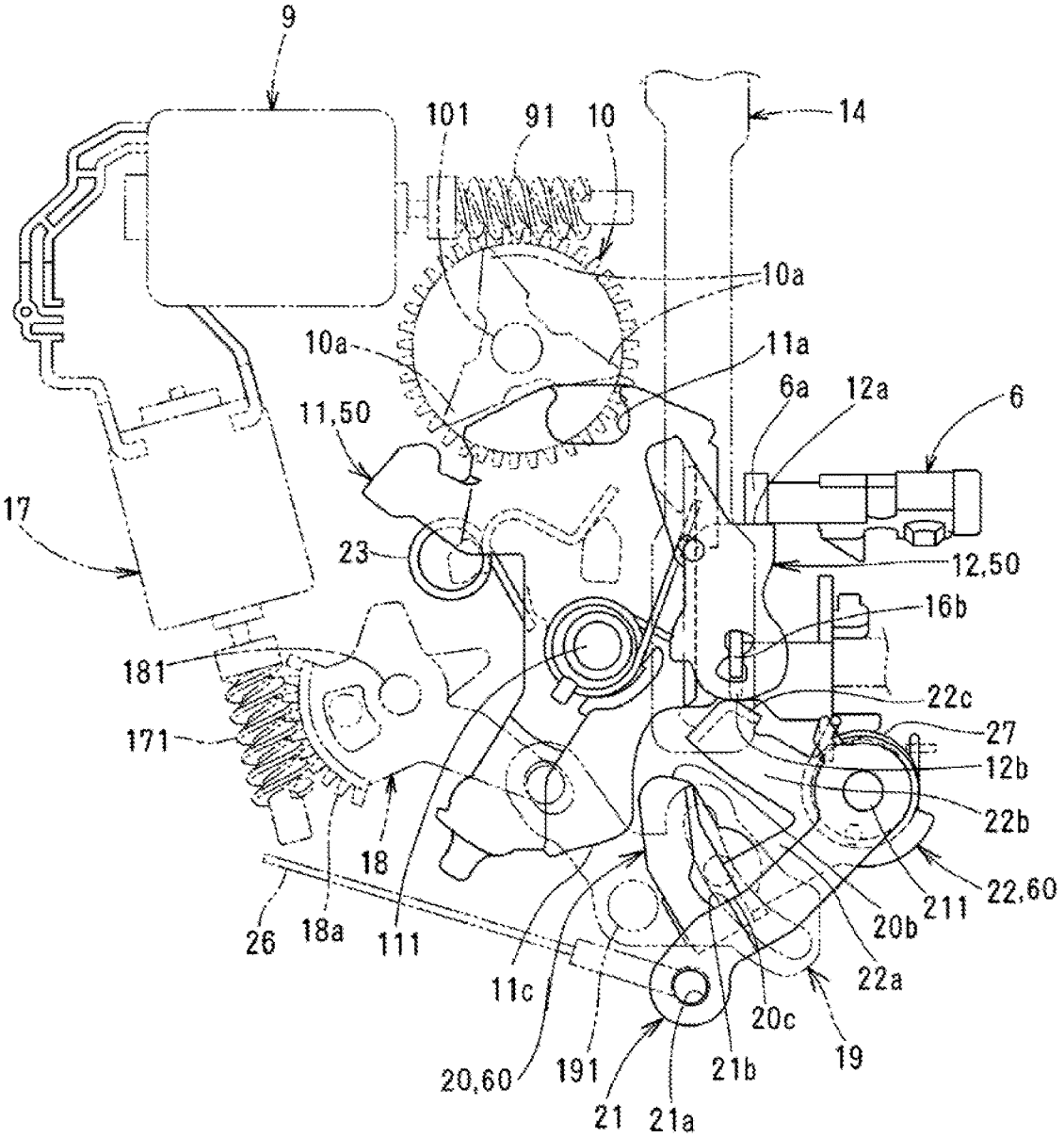
FIG. 9 is a side view of the main part when the one-motion operation is performed.

As shown in FIG. 6, when locking mechanism 50 is in the locked state and double locking mechanism 60 is in the double unlocked state, ratchet 6 cannot perform the release operation, unlike the above, even if sub lever 12 performs the release operation based on the door opening operation of outside handle OH. Therefore, the door cannot be opened by the door opening operation of outside handle OH. On the other hand, as shown in FIG. 9, switching element 20 and second inside lever 22 work in conjunction with the release operation of first inside lever 21 to perform the release operation by the operation of inside handle IH.

Unlocking abutting portion 20*b* of switching element 20 abuts abutting portion 11*c* of locking lever 11 (an example of a part of locking mechanism 50) at the initial stage of the release operation, and thereby switching element 20 moves locking lever 11 from the locked position to the unlocked position. Due to this movement, sub-lever 12 also moves from the locked position to the unlocked position. Immediately after locking lever 11 and sub lever 12 move to the unlocked positions, the release abutting portion 22*c* of second inside lever 22 abuts lower portion 12*b* of sub lever 12, thereby second inside lever 22 causes sub lever 12 to perform the releasing operation, which, in turn, causes ratchet 6 to perform releasing operation to open the door. Therefore, locking mechanism 50 is switched from the locked state to the unlocked state to open the door by the one-motion operation of inside handle IH.

Figure 10:
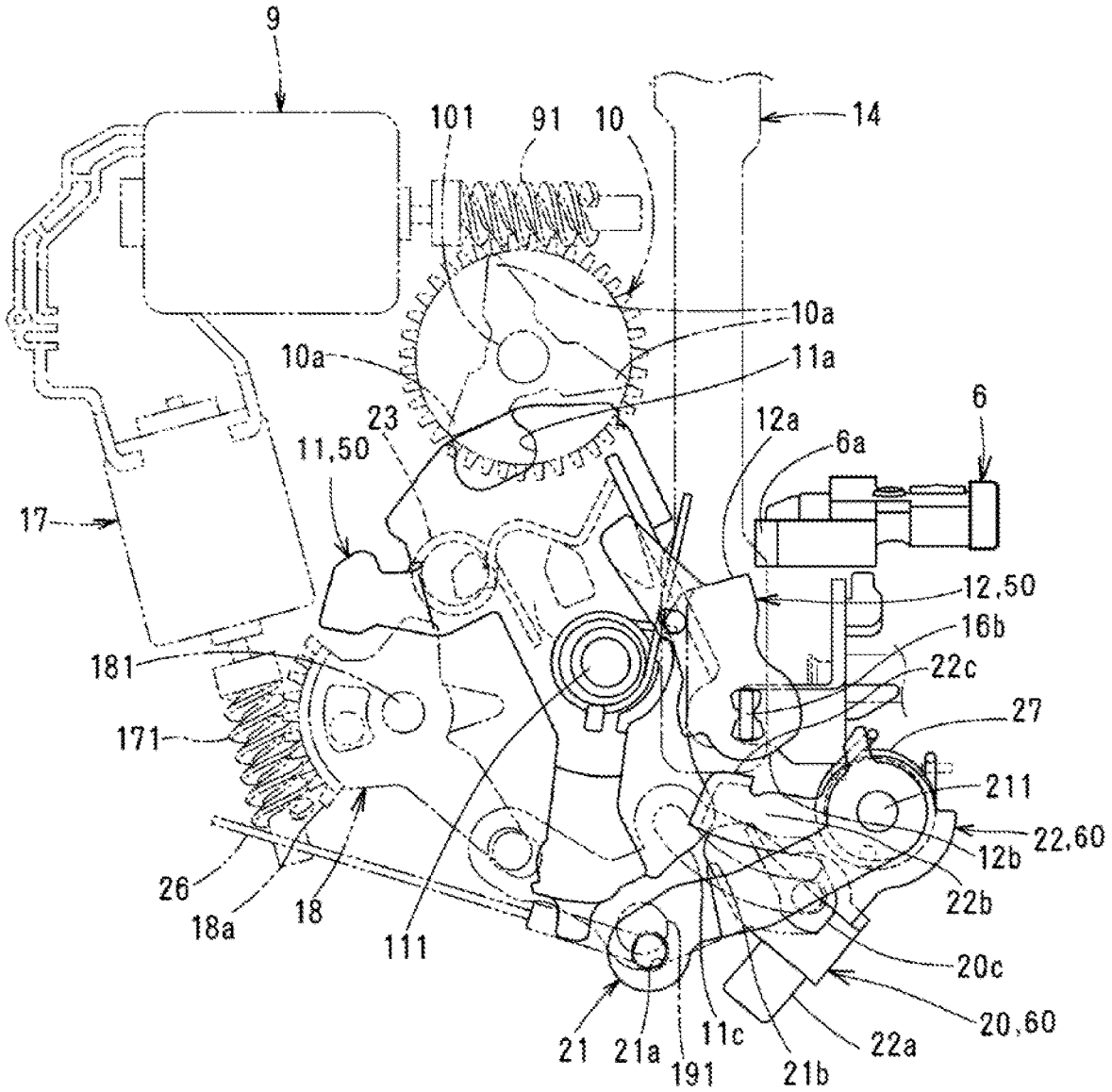
FIG. 10 is a side view of the main part when the double locking mechanism is in the double locked state and the inside handle is operated.

As shown in FIG. 7, when locking mechanism 50 is in the locked state and double locking mechanism 60 is in the double locked state, the door cannot be opened by the door opening operation of outside handle OH. In case of the door opening operation by inside handle IH, the door cannot be opened unless locking mechanism 50 is switched from the locked state to the unlocked state. That is, when the door opening operation is performed by inside handle IH, since switching element 20 is in the disconnected position, the release operation of first inside lever 21 is transmitted neither to switching element 20 nor to second inside lever 22, as shown in FIG. 10. Therefore, the one-motion operation of inside handle IH is prevented.

The present embodiment has been described. As described above, by setting double locking mechanism 60 of vehicle door latch apparatus 1 to the double locked state when parking a vehicle, not only the door opening operation of outside handle OH, but also the one-motion operation of inside handle IH become impossible. Therefore, it is only possible to switch locking mechanism 50 from the locked state to the unlocked state and to switch double locking mechanism 60 from the double locked state to the double unlocked state by the operation of the remote operation switch or by the operation of key cylinder K, carried by a driver, and thus, an illegal act to open the door is prevented.

Furthermore, since it is possible to switch double locking mechanism 60 between the double unlocked state and the double locked state and to switch locking mechanism 50 from the locked state to the unlocked state with the one-motion operation by single switching element 20, the configuration of vehicle door latch apparatus 1 can be simplified.

While the present embodiment has been described above, the following various modifications and changes can be made to the present embodiment without departing from the gist of the present invention.

(i) First motor 9 and second motor 17 may be changed to solenoids, respectively.

(ii) Switching element 20 may be directly connected to second motor 17.

(iii) Instead of the embodiment in which when second inside lever 22 performs the releasing operation, release abutting portion 22*c* abuts against lower portion 12*b* of sub-lever 12 in order to open the door, release abutting portion 22*c* may abut against arm portion 6*a* of ratchet 6 in order to open the door.

While several preferred forms of the invention have been shown and described in detail, it should be understood that various changes and modifications can be made without departing from the spirit or scope of the appended claims.

LIST OF REFERENCE NUMERALS

1 Vehicle door latch apparatus
2 First housing
2*a* Striker entering groove
3 Shaft
4 Latch
5 Shaft
6 Ratchet
6*a* Arm portion
7 Second housing
8 Cover
9 First motor
91 Worm
10 Worm wheel
10*a* Protrusion
101 Support shaft
11 Locking lever
11*a* Engaging groove
11*b* Connecting protrusion
11*c* Abutting portion
111 Support shaft
12 Sub lever
12*a* Releasing portion
12*b* Bottom portion
13 Key lever
13*a* Outer arm portion
13*b* Inner arm portion
14 Slide lever
14*a*, 14*b* Elongate hole
14*c* Lower end portion
15 First outside lever
15*a* Connecting hole
15*b* Bent portion
151 Support shaft
16 Second outside lever
16*a* Abutting portion
16*b* Arm portion
161 Support shaft
17 Second motor
171 Worm
18 First connecting lever
18*a* Sector gear portion
18*b* End portion
181 Support shaft
19 Second connecting lever
19*a* Protrusion
19*b* Elongate hole
191 Support shaft
20 Switching element
20*a* Rectangular hole
20*b* Abutting portion
20*c* Abutted portion
21 First inside lever
21*a* Connecting portion
21*b* Abutting portion

211 Support shaft
22 Second inside lever
22*a* First arm portion
22*b* Second arm portion
22*c* Release abutting portion
23 Spring
24 Back plate
25 Bowden cable
26 Bowden cable
27 Spring
28 Coupling rod
30 Engaging unit
32 Engaging element
40 Operation unit
42 Operating element
50 Locking mechanism
60 Double locking mechanism
S Striker

What is claimed is:

1. A vehicle door latch apparatus comprising:

a locking lever that is switchable between an unlocked state in which a door is capable of being opened by operation of an outside handle that is provided on an outer side of the door and a locked state in which the door is not capable of being opened by the operation of the outside handle;

a first inside lever that performs a releasing operation by an operation of an inside handle that is provided on an inner side of the door;

a second inside lever that is linkable to and is unlinkable from the release operation of the first inside lever; and a switching element that moves between a connected position and a disconnected position, wherein the release operation of the first inside lever is capable of being transmitted to the second inside lever in the connected position, and the release operation of the first inside lever is not capable of being transmitted to the second inside lever in the disconnected position, wherein the switching element includes:

an abutted portion, wherein, when the first inside lever performs the releasing operation in the connected position, the abutted portion abuts against the first inside lever, and thereby the release operation of the first inside lever is capable of being transmitted to the second inside lever, and when the first inside lever performs the releasing operation in the disconnected position, the abutted portion does not abut against the first inside lever, and thereby the release operation of the first inside lever is not capable of being transmitted to the second inside lever; and an unlocking abutting portion, wherein, in the connected position, the unlocking abutting portion is capable of abutting against the locking lever in the locked state, wherein the switching element is in a double unlocked state when the switching element is in the connected position and is in a double locked state when the switching element is in the disconnected position, wherein the double unlocked state enables a one-motion operation, in which the first inside lever abuts against the abutted portion and the unlocking abutting portion abuts against the locking lever by the switching element being linked to the release operation of the first inside lever in order to switch the locking lever from the locked state to the unlocked state, and in which the release operation of the first inside lever is transmitted to the second inside lever in order to open the door, and wherein in the double locked state, when the first inside lever performs the releasing operation, the first inside lever does not abut against the abutted portion and thereby prevents the release operation of the first inside lever from being transmitted to the second inside lever and prevents the locking lever from being switched from the locked state to the unlocked state.

2. The vehicle door latch apparatus according to claim 1, wherein the abutted portion of the switching element is within a trajectory of rotation of an abutted portion of the first inside lever when the switching element is in the connected position, and the switching element transmits the release operation of the first inside lever to the second inside lever.

3. The vehicle door latch apparatus according to claim 1, wherein the abutted portion of the switching element is outside of a trajectory of rotation of an abutting portion of the first inside lever when the switching element is in the disconnected position, and the switching element prevents the release operation of the first inside lever from transmitting to the second inside lever.

4. The vehicle door latch apparatus according to claim 1, wherein the switching element is supported by the second inside lever such that the switching element is movable in a radial direction of the second inside lever.

5. The vehicle door latch apparatus according to claim 1, wherein the switching element has a through hole, and the switching element is supported by the second inside lever by a portion of the second inside lever extending into the through hole.

6. The vehicle door latch apparatus according to claim 1, wherein the first inside lever and the second inside lever are supported by a same shaft.

* * * * *